US005717829A

United States Patent [19]

Takagi

[11] Patent Number: 5,717,829

[45] Date of Patent: Feb. 10, 1998

[54] PITCH CONTROL OF MEMORY ADDRESSING FOR CHANGING SPEED OF AUDIO PLAYBACK

[75] Inventor: Satoshi Takagi, Kanagawa, Japan

[73] Assignee: Sony Corporation, Tokyo, Japan

[21] Appl. No.: 507,671

[22] Filed: Jul. 25, 1995

[30] Foreign Application Priority Data

Jul. 28, 1994 [JP] Japan ..... 6-177050
Jul. 14, 1995 [JP] Japan ..... 7-178687

[51] Int. Cl.[6] ..... G10L 3/02; G10L 9/08

[52] U.S. Cl. ..... 395/2.94; 395/2.26; 395/2.76

[58] Field of Search ..... 360/8; 395/2.16, 395/2.2, 2.76, 2, 2.1, 2.14, 2.22, 2.67, 2.77, 2.94, 2.95, 2.93, 2.92, 2.87, 2.26, 2.74, 2.91, 2.25; 369/60; 381/54

[56] References Cited

U.S. PATENT DOCUMENTS 4,464,784 8/1984 Agnello ..... 381/61
4,653,098 3/1987 Nakata et al. ..... 395/2.16
4,700,391 10/1987 Leslie, Jr. et al. ..... 395/2.16
4,791,671 12/1988 Willems ..... 395/2.26
4,959,865 9/1990 Stettiner et al. ..... 395/2.42
5,233,660 8/1993 Chen ..... 395/2.17

OTHER PUBLICATIONS

Edward P. Neuburg, "Simple pitch-dependent algorithm for high-quality speech rate changing," J. Acoust. Soc. Amer. 63(2), pp. 624–625, Feb. 1978.

*Primary Examiner*—Allen R. MacDonald
*Assistant Examiner*—Donald L. Storm
*Attorney, Agent, or Firm*—Jay H. Maioli

[57] ABSTRACT

The playback speed of an audio signal is decreased or increased by repeatedly reproducing a preset audio signal domain or removing a domain of the audio signal. A memory stores the audio signal and an audio pitch is calculated from the audio signal readout from the memory. The audio pitch and information relating to power of the audio signal are used to produce a memory address sample set to be used in addressing the memory to reading out the audio signal at a desired playback speed. An address phase signal is fed back from a memory address controller to prevent over running or gaps from being formed in the audio signal reading out.

2 Claims, 6 Drawing Sheets

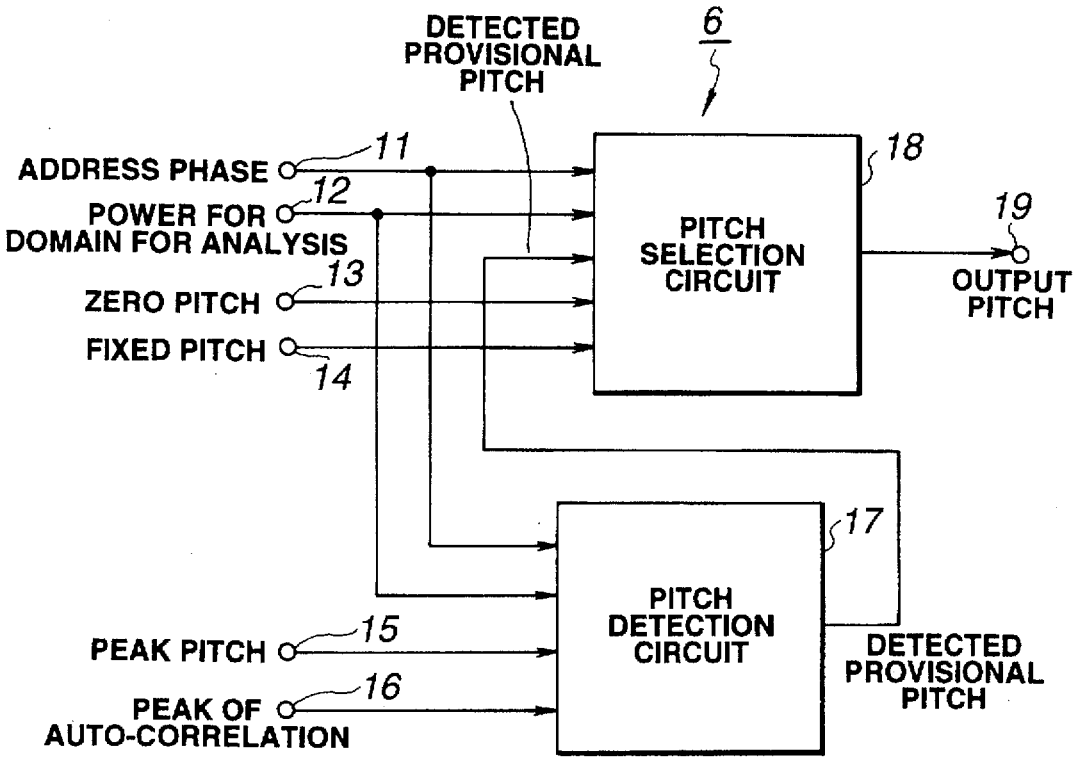
FIG.5
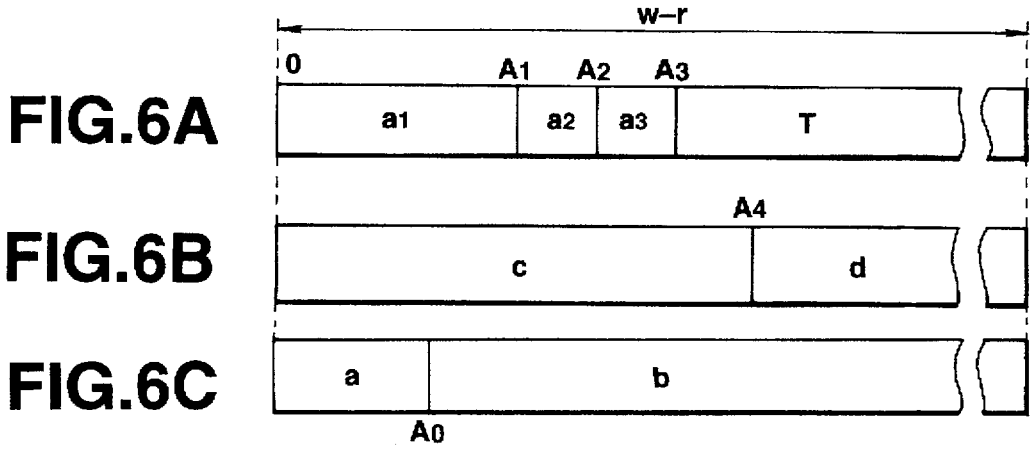

PITCH CONTROL OF MEMORY ADDRESSING FOR CHANGING SPEED OF AUDIO PLAYBACK

BACKGROUND OF THE INVENTION

This invention relates to an audio signal processing apparatus for effecting signal processing at the time of reproducing audio signals.

In a digital video tape recorder (DVTR), a digital audio tape recorder or a karaoke equipment, there may be occasions wherein, when reproducing audio signals recorded on a recording medium, the playback speed of audio signals recorded on the recording medium is increased or decreased without changing the level (pitch) of the playback sound. This operation, generally termed the program play function, is performed for controlling the length of duration of the audio signals. Specifically, for a slow playback speed, a pre-set audio signal domain is repeatedly reproduced, whereas, for a fast playback speed, a pre-set audio signal domain is removed in effecting reproduction for reversion to the pitch used for recording. There are a number of methods used for determining the length of the audio signal domain which is to be repeated or removed. In an inexpensive karaoke equipment, for example, the duration is a fixed length of an audio signal domain. For controlling the length of time duration of audio signals in which high-quality speech is required, audio pitch collection employing the length of time duration determined on the basis of the pitch of audio signals of each domain for analysis of audio signals, that is the sound pitch, is frequently performed.

FIG. 1 schematically shows the constitution of an audio signal processing apparatus for carrying out the audio pitch collection.

Audio data supplied to a signal input terminal 61 of the audio signal processing apparatus is first written in a memory 62. The audio data thus stored in the memory 62 is subsequently read out and sent to an audio junction processor 63 and to a pitch extractor 64. The pitch extractor 64 calculates an audio pitch period of audio data sent in succession thereto. The calculated audio pitch period is sent to a memory address controller 65. The memory address controller calculates the memory addresses based upon the audio pitch period supplied thereto. The calculated memory address is sent to a memory 62. The audio data stored in the memory 62 is read out in accordance with the memory address sent to the memory 62. The audio data thus read out is sent to the audio junction processor 63 in a manner as described above. The audio junction processor 63 performs junction processing in order to avoid occurrence of non-continuity in the audio data transmitted thereto. In a majority of cases, the audio junction processor 63 exploits cross-fading. The audio data, thus processed with junction processing, is outputted at a signal output terminal 66.

It is noted that the audio pitch calculated at the pitch extractor 64 of FIG. 8 is not synchronized with the rate of change of the length of time duration of audio signals. Consequently, if simply the data repetition or removal is carried out in terms of the audio pitch period calculated at the pitch extractor 64 as a unit, it may occur that the write address in the memory 62 outruns the readout address or conversely the readout address outruns the write address. For example, if the rate of change of the length of time duration of audio signals is +10%, that is if the playback speed is faster by 10%, it is necessary to expand the time axis for playback signals based upon the rate of change and to remove part of the signal being reproduced for reverting the pitch of the playback signals to the pitch used at the time of recording. If the number of audio samples per each analysis domain duration is 1024, it is necessary to extract 102.4 samples. However, if 80 samples are calculated as the audio pitch period, the write address proceeds in a direction to overtake the readout address, so that the vacant space in the memory 62 is diminished. If this situation is continued, the write address ultimately outruns the readout address. This incurs collision between the write address and the readout address, thus producing the noise in the audio signal.

OBJECT AND SUMMARY OF THE INVENTION

It is therefore an object of the present invention to provide an audio signal processing apparatus in which noise is not produced when reproducing audio signal while increasing or decreasing the playback speed.

According to the present invention, there is provided an audio signal processing apparatus having memory means for storing an input audio signal, pitch extracting means for reading out the audio signal from the memory means for calculating the audio pitch and power information, address phase managing means for outputting a memory address sample set providing an auto-correlation peak in a selected time duration of the audio signal with the aid of the audio pitch and power information from the pitch extracting means for outputting the memory address sample set, and memory address control means for calculating the memory address for the memory means using the memory address sample set from the address phase managing means.

The power for a domain for analysis and an auto-correlation peak are outputted as the power information from the pitch extraction means.

The address phase managing means has pitch detecting means for detecting, based upon the address phase information from the memory address controlling means, whether or not the memory address sample set from the pitch extracting means is valid, and outputting an audio pitch based upon the results of detection, and pitch selection means for selecting a more appropriate memory address sample set using the audio pitch from the pitch detection means.

A zero pitch and a fixed pitch are supplied to the address phase managing means.

According to the present invention, the audio data is sent to pitch extracting means when the audio data is read out from memory means and outputted after it is temporarily stored in the memory means. The pitch extracting means calculates the audio pitch of the audio data sent thereto, while the address phase managing means calculates the final memory address sample set based upon the address phase from the memory address control means with the aid of the calculated memory address sample set for continuously outputting the audio data from the memory means.

BRIEF DESCRIPTION OF THE DRAWINGS

FIG. 5 schematically shows a constitution of an address phase manager in the audio signal processing apparatus shown in FIG. 2.

FIGS. 6A to 6C are a representation showing the relationship of the threshold values $A_0$–$A_4$ to the memory phases a–d and T.

DESCRIPTION OF THE PREFERRED EMBODIMENTS

Figure 1:
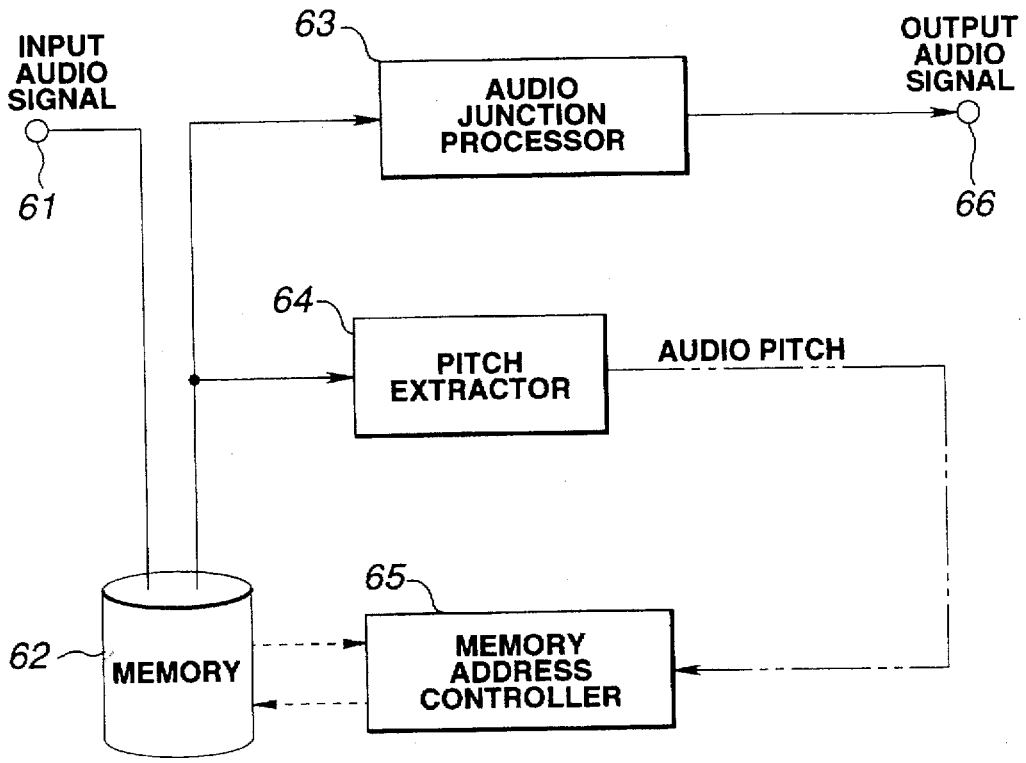
FIG. 1 schematically illustrates a constitution of a conventional audio signal processing apparatus.
Figure 2:
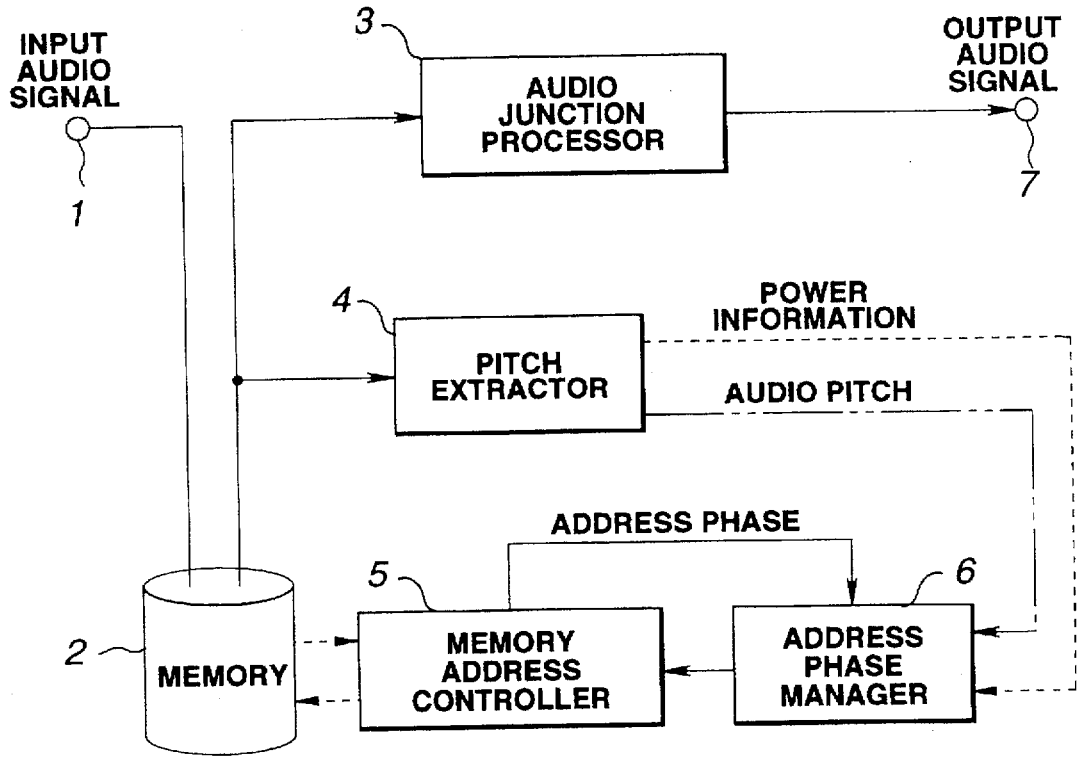
FIG. 2 schematically illustrates a constitution of an audio signal processing apparatus according to the present invention.

Referring to the drawings, preferred embodiments of the present invention will be explained in detail. In FIG. 2, there is shown a schematic arrangement of an audio signal processing apparatus according to the present invention.

Audio data supplied to a signal input terminal 1 is first written in a memory 2. The audio data thus written in the memory 2 is read out and sent to an audio junction processor 3 and to a pitch extractor 4.

The pitch extractor 4 calculates the audio pitch of audio data sent in succession thereto. If the pitch extractor 4 operates according to, for example, an auto-correlation method, it calculates an auto-correlation function for a domain for pitch analysis, and outputs a correlation lag affording the maximum peak of the auto-correlation function as an audio pitch.

An address phase manager 6 is fed with the audio pitch and power information from the pitch extractor 4, as will be explained subsequently. The address phase manager refines the audio pitch based upon the audio pitch and power information supplied thereto and the difference in relative position between the readout address and the write address with respect to the memory 2 (address phase) and sends a memory address sample set to a memory address controller 5. The readout address and the write address are also referred to herein simply as memory addresses. The memory address controller 5 calculates the readout addresses based upon the memory address sample set, as will be explained subsequently. The calculated readout addresses are sent to the memory 2. The audio data stored in the memory 2 is read out in accordance with the readout addresses sent to the memory 2. The audio data thus read out is sent to the audio junction processor 3. The audio junction processor 3 performs junction processing in order to avoid occurrence of non-continuity in the audio data transmitted thereto. The audio data, thus processed with junction processing, is outputted at a signal output terminal 7.

The audio pitch is analyzed at the pitch extraction unit 4 at an interval of a pre-set analysis domain, for example, every 1024 samples. The pitch extractor 4 finds the auto-correlation function of the audio data within the domain of analysis and outputs the power within the domain for analysis, that is the power for the domain for analysis, maximum peak value of auto-correlation, that is peak of auto-correlation, and the lag of correlation corresponding to the maximum peak value, that is the peak pitch.

Figure 3A:
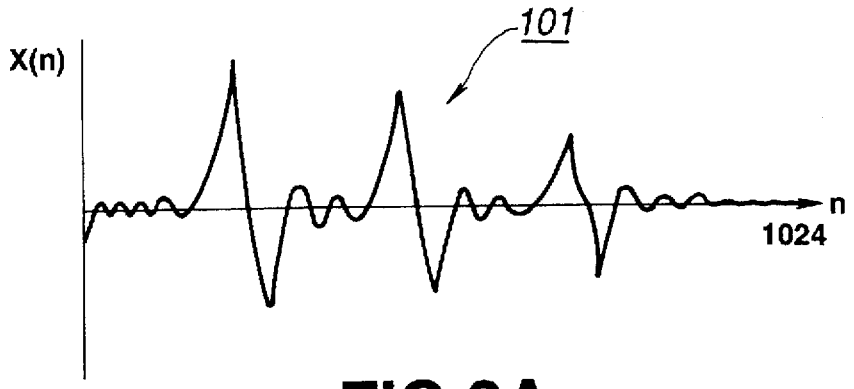
FIGS. 3A and 3B are graphs for illustrating pitch detection in the audio signal processing apparatus shown in FIG. 2.

In FIG. 3A, there is shown a curve 101 as an example of a curve showing the relation between the number of samples n obtained on sampling at an interval of the pre-set domain for analysis, for example, every 1024 samples, and the sample-based amplitude X(n).

Figure 3B:
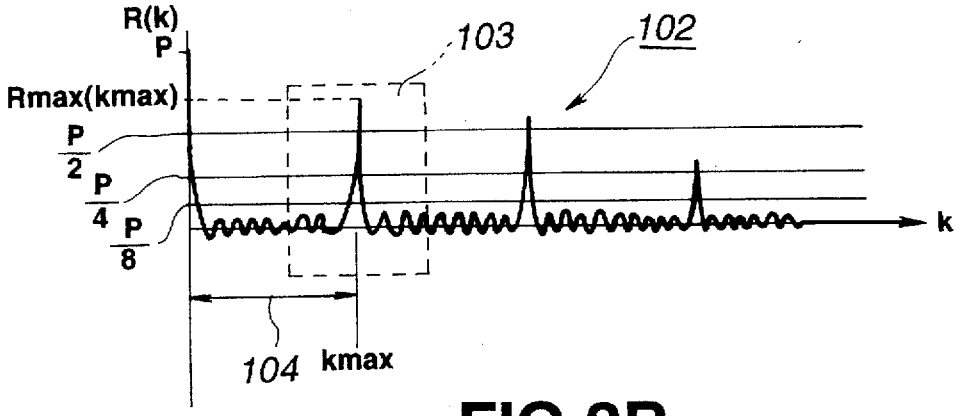

In FIG. 3B, there is shown a curve 102 showing the relation between the lag of auto-correlation or a shift amount k and the intensity R(k) per each shift amount in an auto-correlation function $\phi(k)$ obtained on multiplying the curve 101 and a curve obtained on slightly shifting the curve 101 towards the sample axis. The intensity R(k) is represented by the auto-correlation function $\phi(k)$.

$$\phi(k)=\frac{1}{N}\sum_{n=0}^{N-1}x(n)x(n+k) \tag{1}$$

In FIG. 3B, the power for the domain for analysis is a value of the intensity R(0) at k=0 in the curve 102, and is denoted as P. The peak of auto-correlation is specified by one of the peaks periodically appearing on the x-axis, for example, the maximum value Rmax ($k_{max}$) shown in, for example, an area 103. On the other hand, the peak pitch is represented by a domain 104 from k=0 to k=$k_{max}$.

However, the audio pitch calculated by the pitch extractor 4 is not synchronized with the rate of change of the length of continuous time duration. Therefore, if simply data removal and repetition is performed in terms of the audio pitch found by the auto-correlation method as a unit, it may be an occurrence that the write address outrun the readout address or conversely the readout address outrun the write address in the memory 2.

For example, if the rate of change of the audio pitch period during the length of continuous time duration is +10%, the deviation due to the above rate of change may be compensated by removing data of 102.4 samples per each domain for analysis (1024 samples) during readout. For example, if 80 samples are calculated as the audio pitch period, the write address proceeds in the direction of overtaking the readout address, as a result of which the address allowance, that is the capacity allowance in the memory, is diminished. If the situation is allowed to persist, there is a risk of the write address overtaking the readout address.

Figure 4:
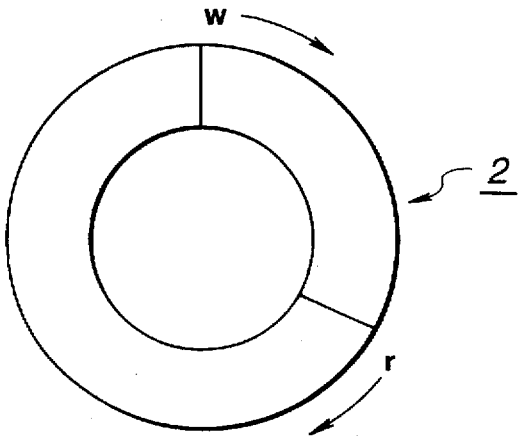
FIG. 4 is a diagrammatic view showing the relative position between the write address and the readout address in the memory in the audio signal processing apparatus shown in FIG. 2.

On the other hand, the memory 2 has a loop structure by having its leading address connected to its last address, as schematically shown in FIG. 4.

In the memory 2 shown in FIG. 4, it may be an occurrence that a write pointer w representing the write address outruns a readout pointer r representing the readout address, or the readout pointer r outruns the write pointer w. It is assumed that the write pointer w and the readout pointer r move clockwise.

Therefore, in order to prevent this from occurring, an address phase manager 6 is provided for supervising the readout address phase and the write address phase in a manner explained subsequently. In effect, address phase management by the address phase manager 6 is realized by refining the audio pitch outputted by the pitch extractor 4 based upon the phase information of the readout and write addresses in the memory 2.

Specifically, audio data writing and readout in or from the memory 2 is controlled on the basis of the readout address and the write address outputted by the memory address controller 5. In addition, the memory address controller 5 controls the readout and write addresses on the basis of the memory address sample set sent from the address phase manager 6.

In addition, control of the readout pointer r and the write pointer w in the memory 2 influences the audio data removal and repetition after delay for a pre-set time interval for preventing collision between the readout and write addresses. That is, the frequency of occurrence of audio data removal and repetition is controlled.

In FIG. 5, there is shown an illustrative arrangement of the address phase controller 6.

To the address phase manager 6, the power for the domain for analysis P, the value of the peak pitch ($k_{max}$) and the auto-correlation peak value Rmax ($k_{max}$) are supplied from the pitch extractor 4 via signal input terminals 12, 15 and 16. On the other hand, and address phase (w–r) from the memory address controller 5, as a difference information between the readout address and the write address in the memory 2, is also supplied via a signal input terminal 11. The address phase (w–r), power for the domain for analysis P, peak pitch ($k_{max}$) and the self-correlation peak value Rmax ($k_{max}$) are sent to a pitch detection circuit 17. The address phase (w–r) is the position difference data between the write pointer w and the readout pointer r and is encoded with two or three bits.

In FIGS. 6A, 6B and 6C, the address phase (w–r) is shown highly schematically.

In the FIG. 6A, the address phase (w–r) is schematically shown by a band-shaped block. The band-shaped block, representing (w–r), is divided at phase values $A_1$, $A_2$ and $A_3$ and thereby divided into four blocks, namely a first block $a_1$, a second block $a_2$, a third block $a_3$ and a fourth block $a_4$. The fourth block T is susceptible to changes in dependence upon the memory capacity.

The pitch detection circuit 17 judges validity of the audio pitch transmitted from the pitch extractor 4.

Specifically, the pitch detection circuit 17 compares the auto-correlation peak value Rmax ($k_{max}$) corresponding to the peak pitch ($k_{max}$) and the power for the domain for analysis P. If the auto-correlation peak value Rmax ($k_{max}$) is larger, the pitch detection circuit judges that the audio data is high in audio data periodicity and hence the pitch is effective audio pitch. In the present specification the audio data periodicity is referred to as the pitch displaying performance. The pitch detection circuit compares, depending upon the state of the address phase (w–r), the auto-correlation peak value Rmax ($k_{max}$) to the power for the domain for analysis multiplied by ½, ¼ and ⅛, that is P/2, P/4 and P/8, as shown in FIG. 3B.

Meanwhile, the values of P/2, P/4 and P/8 correspond to the amounts of reversion of the readout pointer r when the write pointer w and the readout pointer r approach each other.

If there is an allowance in the address phase (w–r), that is if there is sufficient allowance until collision between the readout address and the write address, the power of P/2, for example, is selected as the comparative pitch at the time of judging the intensity of Rmax ($k_{max}$) for rigorously judging the pitch displaying performance. If validity as the audio pitch is conformed, the input peak pitch is directly outputted. If the pitch displaying performance is found to be low irrespective of the states of the address phase (w–r), that is if the pitch displaying performance is found to be low even if the power of P/8 is selected as the comparative pitch, a zero pitch is outputted as the audio pitch. This indicates that valid audio pitch has not been detected in this domain for analysis.

The audio pitch outputted by the above pitch detection circuit 17 based upon the above judgement is supplied as a provisional detection pitch to a pitch selection circuit 18.

Figure 7:
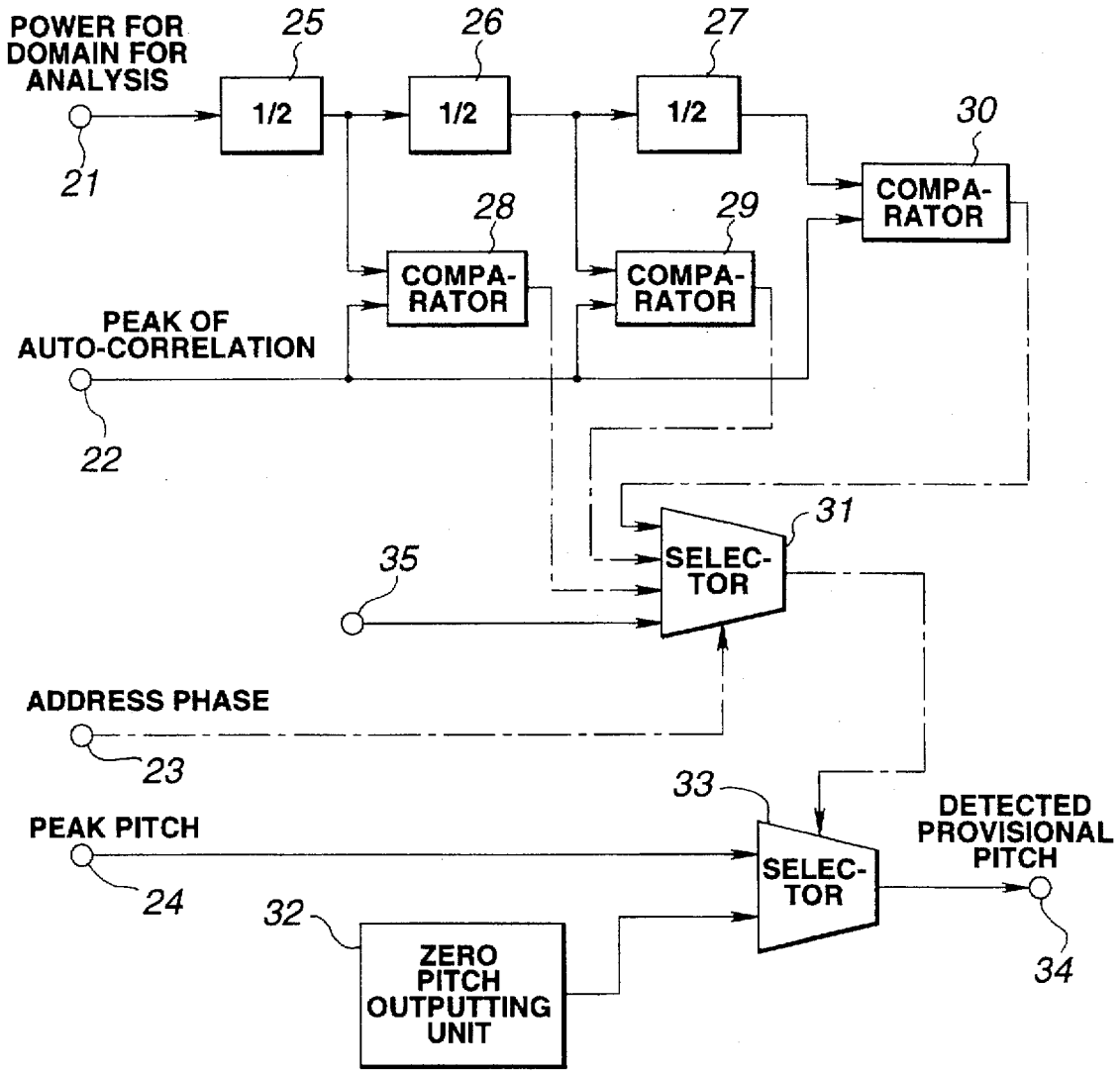
FIG. 7 shows an illustrative constitution of a pitch detection circuit in the audio signal processing apparatus shown in FIG. 2.

FIG. 7 shows an illustrative construction of the pitch detection circuit 17.

The power for the domain for analysis P, supplied to a signal input terminal 21, is sent to a ½ circuit 25 for conversion to a one-half of the power for the domain for analysis P, that is to P/2 power, before being sent to a ½ circuit 26 and a comparator 28.

The comparator 28 is fed with the auto-correlation peak value Rmax ($k_{max}$) from a signal input terminal 22 so that the P/2 power is compared to the auto-correlation peak value Rmax ($k_{max}$). If the result of comparison indicates that the auto-correlation peak value Rmax ($k_{max}$) is larger than the P/2 power, the phase value $A_3$ is sent to a selector 31 and, if otherwise, data "0" is sent to the selector 31.

The ½ circuit 26 further halves the P/2 power, that is converts the P/2 power into a power equal to one-fourth the original power for the domain for analysis P. This power is referred to hereinafter as a P/4 power. The P/4 power is sent to a ½ circuit 27 and a comparator 29.

The comparator 29 is fed with the auto-correlation peak value Rmax ($k_{max}$), so that the P/4 power and the auto-correlation peak value Rmax ($k_{max}$) are compared to each other. If the result of comparison indicates that the auto-correlation peak value Rmax ($k_{max}$) is larger than the P/4 power, the phase value $A_2$ is sent to the selector 31 and, if otherwise, data "0" is sent to the selector 31.

The ½ circuit 27 further halves the P/4 power, that is converts the P/4 power into a power equal to one-eighth the original power for the domain for analysis P. This power is referred to hereinafter as a P/8 power. The P/8 power is sent to a comparator 30.

The comparator 30 is fed with the auto-correlation peak value Rmax ($k_{max}$), so that the P/8 power and the auto-correlation peak value Rmax ($k_{max}$) are compared to each other. If the result of comparison indicates that the auto-correlation peak value Rmax ($k_{max}$) is larger than the P/8 power, the phase value $A_1$ is sent to the selector 31 and, if otherwise, data "0" is sent to the selector 31.

The selector 31 employs the address phase (w–r) from the signal input terminal 23 as a switching control signal and selects one of the phase values $A_1$, $A_2$ and $A_3$, data "0" and a signal "1" indicating the fourth block T as a signal indicating the fourth block T from the signal input terminal 35, shown in FIG. 6, and outputs data "0" or "1" as the result of selection. The output data is sent to a selector 33 so as to be used as a changeover control signal for the selector 33. The selector 31 has a decoder for temporarily decoding the digitally encoded address phase (w–r).

The selecting operation by the selector 31 will be explained.

Each of the phase values $A_1$, $A_2$ and $A_3$ has a relation to each other as shown in FIG. 6A. The selector 31 puts priority on the phase value of input phase values which is furthest from the phase value 0. That is, in the selecting operation, the maximum phase value among the phase values $A_1$, $A_2$ and $A_3$, or the signal "1", is selected.

If, for example, the phase value $A_3$ is the maximum phase value, a signal "1" or "0" is outputted if the address phase (w–r) is larger or smaller than the phase value $A_3B$, respectively. If the phase value $A_2$ is the maximum phase value, or if the phase value $A_1$ is the maximum phase value, a signal "1" or "0" is outputted in a similar manner. If there exists no maximum phase value, that is if no peak is detected within a domain for analysis, a signal "1" is outputted.

On the other hand, the selector 33 is fed with a peak pitch $k_{max}$ from the signal input terminal 24 and the zero pitch from a zero pitch outputting unit 32. A zero pitch or the peak pitch $k_{max}$ is selected if the data sent from the selector 31 is the data "1" or "0", respectively, and the results of selection are outputted as a provisional detection pitch at a signal output terminal 34.

Returning to FIG. 5, the pitch selection circuit 18 is fed with the address phase (w–r) from the signal input terminal 11 and the power for the domain for analysis P from the signal input terminal 12, while being also fed with the zero pitch from the signal input terminal 13 and with the fixed pitch from the signal input terminal 14. The pitch selecting circuit 18 further refines the provisional detection pitch transmitted thereto using the address phase (w–r) and the power for the domain for analysis P similarly transmitted thereto. Specifically, the audio pitch is selected from among the provisional detection pitch outputted from the pitch detection circuit 17, a provisional pitch which is twice the provisional detection pitch, a provisional pitch which is four times the provisional detection pitch, a fixed pitch and a zero pitch.

The fixed pitch is a value accorded from outside and may be exemplified by a value corresponding to the maximum value of the rate of change of the length of the continuous time duration of audio data. If, for example, the rate of change of the length of the continuous time duration of audio signals is in a range from +15% to −15%, and the length of the domain for pitch analysis is 1024 samples, an integer corresponding to a rounded-up value of 1024×15% may be adopted as a fixed pitch.

If the detected provisional pitch is of a short period, the audio pitch is doubled or quadrupled. The decision as to whether or not the detected provisional pitch is short is given by comparing the detected provisional pitch to the above-mentioned fixed pitch. The pitch selection circuit 18 selects the output pitch from among the detected provisional pitch, the provisional pitch which is twice the provisional detection pitch, the provisional pitch which is four times the provisional detection pitch, the fixed pitch and the zero pitch. If the power for the domain for analysis P is small, and if there is allowance in the address phase (w–r), the zero pitch is outputted as the memory address sample set.

On the other hand, if there is no allowance of the address phase (w–r), the fixed pitch is outputted as the memory address sample set. In addition, if the power for the domain for analysis P is small, and if there is allowance in the address phase (w–r), the detected provisional pitch transmitted from the pitch detection circuit 17 is outputted as the audio pitch. If the audio pitch is small, the value of the detected provisional pitch is refined by being doubled or quadrupled to an audio pitch close to the fixed pitch, and the memory address sample set thus produced is outputted. If the power for the domain for analysis P is higher than a pre-set threshold but there is no allowance in the address phase (w–r), the fixed pitch is outputted as the memory address sample set.

Figure 8:
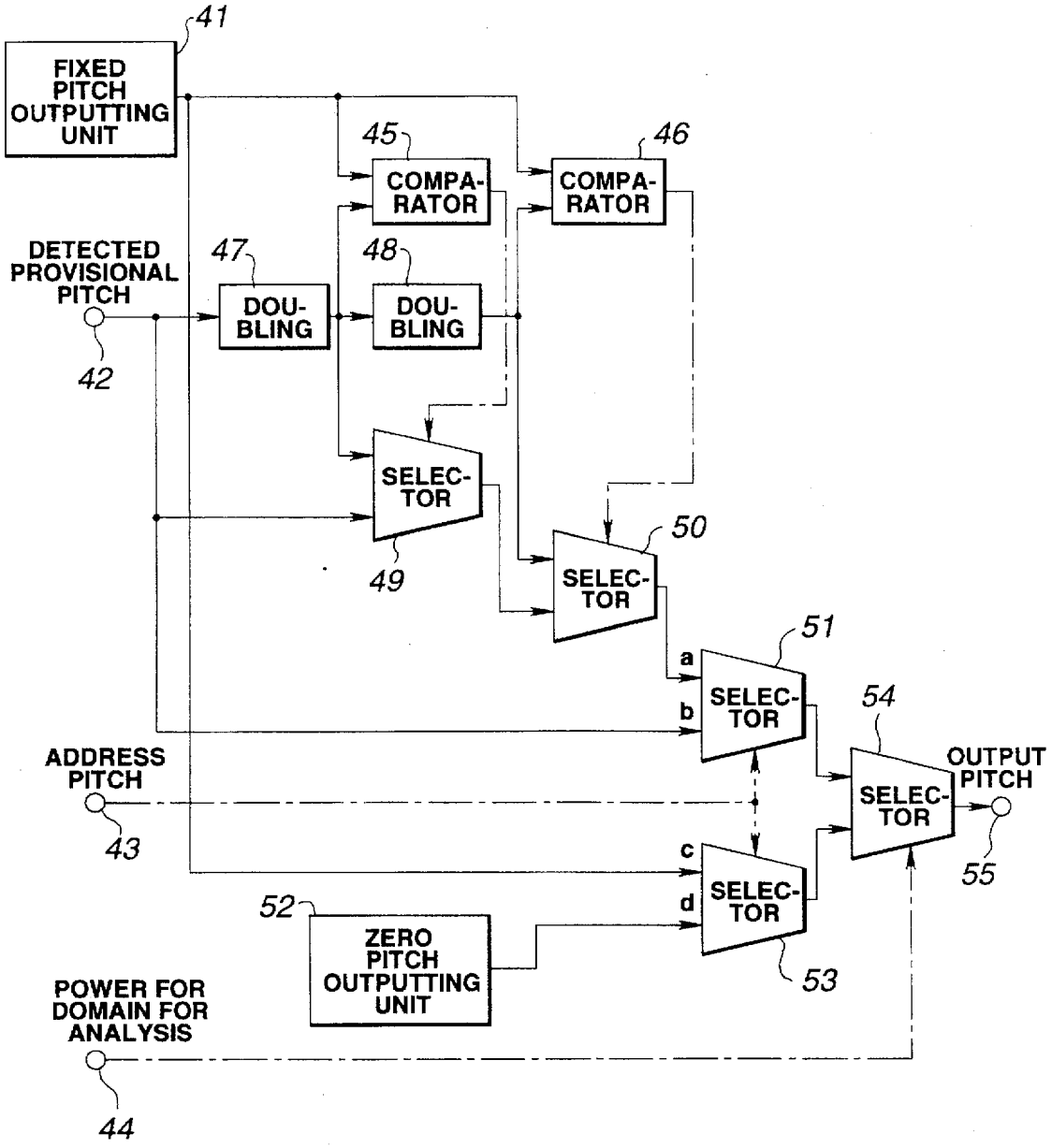
FIG. 8 shows an illustrative constitution of a pitch selection circuit in the audio signal processing apparatus shown in FIG. 2.

FIG. 8 shows an illustrative example of the pitch selecting circuit.

The fixed pitch from the fixed pitch outputting unit 41 of the pitch selector is supplied to comparators 45, 46, while being fed as an output c to a selector 53. The detected provisional pitch, outputted by the pitch detection circuit shown in FIG. 7, is fed via a signal input terminal 42 to the pitch selection circuit. That is, the detected provisional pitch is fed to a frequency doubler 47 and a selector 49, while being fed as an output b to a selector 51.

The frequency doubler 47 doubles the period of the detected provisional pitch and sends the audio pitch which is twice the detected provisional pitch, referred to herein as a doubled audio pitch, to the comparator 45, frequency doubler 48 and to the selector 49.

The comparator 45 compares the fixed pitch from the fixed pitch outputting unit 41 to the doubled audio pitch from the frequency doubler 47 and transmits data "0" or "1" to the selector 49 if the results of comparison indicates that the doubled audio pitch is smaller or larger than the fixed pitch, respectively. The results of comparison is employed as a changeover control signal for the selector 49.

The selector 49 selects, based upon the results of comparison from the comparator 45, one of the detected provisional pitch or the doubled audio pitch. If, as the results of selection, data "0" or data "1" is supplied, the selector 49 outputs the doubled audio pitch or the detected provisional pitch to a selector 50, respectively.

The frequency doubler 48 further doubles the doubled audio pitch and transmits the resulting audio pitch, that is the audio pitch four times the detected provisional pitch, referred to herein as a quadrupled audio pitch, to the comparator 46 and the selector 50.

The comparator 48 compares the fixed pitch to the quadrupled audio pitch and transmits data "0" or data "1" to the selector 50 if the results of comparison indicate that the quadrupled audio pitch is smaller or larger than the fixed audio pitch, respectively. The results of comparison are used as changeover control signals for the selector 50.

The selector 50 selects, based upon the results of comparison from the comparator 48, one of the above-mentioned quadrupled audio pitch or the audio pitch outputted as the result of selection from the selector 49. If, as the result of selection, the data "0" or "1" are supplied, the quadrupled audio pitch or the output of the selector 49 is selected, respectively. The result of selection is sent as an output a to the selector 51.

The selector 51 selects, using the address phase (w–r) supplied from the signal input terminal 43, one of the result of selection from the selector 50 as the output a or the detected provisional pitch as the output b, and routes the selected audio pitch as the result of selection to a selector 54.

The selecting operation by the selector 51 is now explained.

The selector 51 uses, as a threshold value for evaluating the address phase (w–r), a phase value $A_0$ as shown in FIG. 6C, wherein, for example, $A_0<A_1$. If the address phase (w–r) is smaller or larger than the phase value $A_0$, the output a or b is selected, respectively.

The selector 53 selects, using the address phase (w–r) supplied via the signal input terminal 43, as a changeover control signal, one of the fixed pitch from the fixed pitch outputting unit 41, as an output c, or a zero pitch from a zero-pitch selector 52, as an output d, and sends the selected audio pitch as the result of selection to a selector 54.

The selecting operation by the selector 53 is now explained.

The selector 51 uses, as a threshold value for evaluating the address phase (w–r), a phase value $A_4$ as shown in FIG. 6B, wherein, for example, $A_4<A_3$. If the address phase (w–r) is smaller or larger than the phase value $A_4$, the output c or d is selected, respectively.

Similarly to the selector 31, each of the selectors 51, 53 has a decoder for decoding the digitally encoded address phase (w–r).

The selector 54 selects, using the power for the domain for analysis P from the signal input terminal 44, the result of selection from the selector 51 or that from the selector 53 if the power for the domain for analysis P is larger or smaller than the pre-set threshold value, respectively. The audio pitch, as the result of selection, is outputted as a memory address sample set at a signal output terminal 55 to the memory address controller 5 shown in FIG. 2.

With the above-described audio signal processing apparatus, if the output a is selected as the output pitch from the address phase manager 6, the power for the domain for analysis P is larger than the pre-set threshold value, with the address phase being smaller. In this case, the detected provisional pitch is doubled or quadrupled so as to be refined to a period close to that of the fixed pitch. The pitch of the refined pitch turns out to be the memory address sample set.

If the output b is selected as the memory address sample set, the power for the domain for analysis P is larger than the pre-set threshold, there being allowance in the address phase. In such case, the detected provisional pitch directly turns out to be the memory address sample set.

If the output c is selected as the memory address sample set, the power for the domain for analysis P is smaller than the pre-set threshold, with the address phase being small. In such case, the fixed pitch turns out to be the memory address sample set.

If the output d is selected as the memory address sample set, the power for the domain for analysis P is smaller than the pre-set threshold, there being allowance in the address phase. In such case, the zero pitch turns out to be the memory address sample set.

Thus the readout pointer r is not retreated if there is allowance in the address phase and the peak pitch is not detected. However, if there is allowance in the address phase but the peak pitch is detected, the readout address is retreated based upon the peak pitch.

On the other hand, if there is no allowance in the address phase and no peak pitch is detected, the readout pointer r is compulsively retreated based upon the fixed pitch. If there is no allowance in the address phase but the peak pitch is detected, the peak pitch is refined to a period close to that of the fixed pitch and is retreated based upon the refined peak pitch.

In addition, since the readout pointer r is controlled responsive to the pitch of the audio data supplied as described above and to the relative position between the write pointer w and the readout pointer r in the memory 2, the write address and the readout address for the memory 2 may be controlled so as not to collide against each other while the audio signals are reproduced with the increasing or decreasing playback speed, so that there is no risk of the noise being produced in the output audio data. Furthermore, there is no risk of aurally unnatural portions being produced in the audio data obtained on processing the audio data outputted responsive to the thus controlled addresses by the audio junction processor 3.

If the above-described audio signal processing apparatus is applied to VTR audio data, the audio data may be kept in a predetermined phase relation with respect to video data, so that the audio data may be prohibited from being drastically advanced or retarded with respect to the video data.

What is claimed is:

1. An audio signal processing apparatus comprising:

memory means for storing an input audio signal;

memory address control means;

pitch extracting means for calculating an audio pitch and power information from the audio signal read out from said memory means;

address phase management means receiving a zero pitch and a fixed pitch for use in outputting a memory address sample set providing an auto-correlation peak in a selected time duration of the audio signal in response to the audio pitch and the power information from said pitch extracting means and including pitch detecting means for detecting whether the audio pitch from said pitch extracting means is a final pitch formed of a number of samples for use in memory address correction in response to a memory address from said memory address control means for outputting a second memory address sample set based upon the results of detection and pitch selection means for selecting a final memory address sample set output from the address phase management means to the memory address control means using the second memory address sample set from said pitch detecting means; and wherein said memory address control means calculates a memory address for said memory means using the memory address sample set from said address phase management means.

2. The audio signal processing apparatus as claimed in claim 1, wherein the auto-correlation peak is outputted as the power information from said pitch extracting means.

* * * * *